US007467725B2

(12) United States Patent
Tanaka et al.

(10) Patent No.: US 7,467,725 B2
(45) Date of Patent: Dec. 23, 2008

(54) SYNTHETIC RESIN BOTTLE HAVING A VACUUM-ABSORBING FUNCTION

(75) Inventors: Toshimasa Tanaka, Tokyo (JP); Takao Iizuka, Tokyo (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 645 days.

(21) Appl. No.: 11/119,760

(22) Filed: May 3, 2005

(65) Prior Publication Data

US 2005/0263481 A1 Dec. 1, 2005

(30) Foreign Application Priority Data

May 27, 2004 (JP) ..... 2004-158034

(51) Int. Cl.
*B65D 1/44* (2006.01)
*B65D 1/02* (2006.01)

(52) U.S. Cl. ..... 215/381; 215/382; 220/675

(58) Field of Classification Search ..... 215/381, 215/900, 379, 382, 383; 220/666, 669, 675
See application file for complete search history.

(56) References Cited

U.S. PATENT DOCUMENTS 3,946,903 A * 3/1976 Parker ..... 222/92
5,222,615 A * 6/1993 Ota et al. ..... 215/375
5,310,068 A * 5/1994 Saghri ..... 215/386
5,337,909 A * 8/1994 Vailliencourt ..... 215/381
5,642,826 A * 7/1997 Melrose ..... 215/382
D406,065 S * 2/1999 Cheng ..... D9/552
5,988,417 A * 11/1999 Cheng et al. ..... 215/383
D426,163 S * 6/2000 Safadi et al. ..... D9/538
6,145,681 A * 11/2000 Chimetto et al. ..... 215/384
6,779,673 B2 * 8/2004 Melrose et al. ..... 215/381
D495,608 S * 9/2004 Klemm et al. ..... D9/552
7,163,123 B2 * 1/2007 Bezek ..... 220/675
2002/0070193 A1 * 6/2002 Mero ..... 215/381

FOREIGN PATENT DOCUMENTS

DE 3937456 A1 * 5/1991
JP 05051036 A * 3/1993
WO WO 00/68095 * 11/2000

* cited by examiner

*Primary Examiner*—Sue A Weaver
(74) *Attorney, Agent, or Firm*—Oliff & Berridge, PLC

(57) ABSTRACT

A synthetic resin bottle includes a body having an upper end and a lower end and a plane cross-sectional shape of a circle, the circle being out-of-round over substantially an entire height of the body. The body includes crests disposed at three or more points on a circumference of the circle at substantially a same interval, wherein a central angle (α) position of each crest fluctuates similarly vertically along the height of the body. The body also includes support ridges formed by the crests in sigmoid curves and disposed at least in three substantially parallel rows at a same interval and panels disposed between adjacent support ridges and provided with slightly swelled panel walls that are reversibly deformable into a dented shape, as seen in cross-sectional plan views.

9 Claims, 13 Drawing Sheets

A—A, G—G Cross-Section

B—B Cross-Section

C—C Cross-Section

D—D Cross-Section

E—E Cross-Section

F—F Cross-Section

PRIOR ART

SYNTHETIC RESIN BOTTLE HAVING A VACUUM-ABSORBING FUNCTION

BACKGROUND

This invention relates to a synthetic resin bottle, which is provided with plural panels used to absorb the changes in inner pressure created inside the bottle.

What is called the hot filling process is used to fill a polyethylene terephthalate resin (hereinafter referred to as PET resin) bottle with contents, such as fruit juices, teas, and the like, for which sterilization is required. It involves filling the bottle with the contents at a temperature of about 90 degrees Centigrade, sealing the bottle with a cap, and cooling the capped bottle. Inside of the bottle turns out to be under a considerably reduced pressure condition.

Therefore, the so-called depressurization-absorbing panels are formed on purpose on the body wall for those uses that involve the hot filling process described above. These panels occupy the areas in which the panel walls are easily deformable into a dented shape when bottle inside is under reduced pressure. Because only the panels are made to get dented under reduced pressure, the bottle itself retains good appearance, and the portions other than the panels have sufficient rigidity as a bottle. Therefore, the bottles have no trouble on the bottle transport lines, in the stacked bottle storage, and inside the automatic vending machines.

Patent Document 1, for example, has the descriptions of a bottle provided with depressurization-absorbing panels. FIG. 13 shows a bottle illustrated in an embodiment of Patent Document 1. This bottle 101 is a cylindrical PET bottle with a capacity of 500 ml, and comprises a neck 102, a shoulder 103, a body 104, a bottom 105, and an encircling groove 106 at bout mid-height. Six depressurization-absorbing panels 107 are formed below this encircling groove 106. The panels 107 are roughly flat in their shape, and are easily deformable into a dented shape when the inside of the bottle 101 is under reduced pressure. Because of these panels 107, the bottle 101 in its appearance gives no impression of a distorted shape, and fulfills the function of absorbing or relieving inconspicuously depressurization (hereinafter referred to as the depressurization-absorbing function). Support pillars 109 are formed between adjacent depressurization-absorbing panels 107 to retain the rigidity of the bottle.

Vertical ribs 108 are shown in a dented shape in FIG. 13, but these ribs may have a projecting shape. However, in the case of dented ribs, thicker walls are obtained for each connecting part between a vertical rib 108 and a vacuum absorbing panel 107 than in the case of projecting ribs, and thus the dented ribs ensure that the support pillars 109 are prevented from deformation.

[Patent Document 1] P1998-58527

In recent years, synthetic resin bottles, such as the PET resin bottles described above, have been in much use for the foods requiring retort treatment in packaging. In such cases, the retort treatment is carried out by filling the bottle with a food at a temperature in the range of room temperature to 80 degrees C. and by utilizing pressurized hot water or heating steam to heat-sterilize the food at a temperature of 120-130 degrees C. for about 20 min in a retort kettle or autoclave in the state in which the neck has been sealed with a cap.

In summer, the above-described synthetic resin bottles, such as PET resin bottles, may also be put in the freezer to enjoy ice-cold drinks as the frozen contents are gradually melted up.

SUMMARY

In this way, the PET resin bottles and other synthetic resin bottles have been being used in various applications. In the case of the bottles to be used for retort foods, the bottles are sealed with the cap and sterilized in the retort kettle or autoclave at a temperature in the range of 120 to 130 degrees C. At that time, inner pressure of the bottle rises because of the expansion of air in the head space and the swelling of the contents. If heated and pressurized water is utilized, the deformation of the bottle into the swelled shape can be controlled by adjusting the pressure of hot water to balance between the inner pressure and the hot water pressure. However, in the case where steam heating is utilized, it is necessary to carry out heat treatment in the vicinity of saturated steam pressure obtained at the temperature employed, and thus, it is impossible to get a balance between the inner pressure and the steam pressure.

For this reason, thin-wall body is deformed into a swelled shape during the retort treatment if the steam-heating process is utilized. In the case of general-purpose resins, such as PET resin, the treatment temperature is higher than glass transition temperature. Unless the bottle has a function enough to absorb the swelling of the body without causing any local deformation (hereinafter referred to as the expansion-absorbing function), then permanent deformation would happen, and the bottle would not return to its original shape at normal pressure but would have some distorted appearance.

Furthermore, when the product is brought to room temperature after the retort treatment, the inner pressure drops. Especially when the bottle is filled with the contents at a temperature in the range of 70 to 80 degrees C., the bottle inside is under reduced pressure at room temperature. Therefore, the bottle is required to be of a structure having also the depressurization-absorbing function. In other words, the bottle is required to have a structure in which the absorbing functions are fulfilled in response to both of pressurization and depressurization, while allowing the bottle to maintain good appearance, and in which smooth deformation takes place in response to a large pressure fluctuation from a pressurized state to a depressurized state.

Meanwhile, if the contents mainly consisting of water are frozen, the volume increases by 1.09 times. In the sealed bottle, inner pressure would rise due to the increase in the volume caused by the freeze, and the bottle could be in danger of burst. Even if the bottle does not burst, it is deformed into a swelled shape. Therefore, there is a need for an expansion-absorbing function enough to avoid distorted appearance and to give no damage to other bottle functions, such as the self-standing ability.

A technical problem addressed by the present disclosure is to create a panel structure capable of suitably fulfilling the function of absorbing depressurization or expansion, and of avoiding distorted appearance, in response to various pressure states, including depressurized state, pressurized state, and a state in which there exist both of pressure and reduced pressure in a bottle. An object of the present disclosure is to provide a synthetic resin bottle that can be utilized in various applications.

A synthetic resin bottle according to an embodiment of the present disclosure incluses a body having an upper end and a lower end and a plane cross-sectional shape of a circle, the circle being out-of-round over substantially an entire height of the body, the body including: crests disposed at three or more points on a circumference of the circle at substantially a same interval, wherein a central angle ($\alpha$) position of each crest fluctuates similarly vertically along the height of the body; support ridges formed by the crests in sigmoid curves and disposed at least in three substantially parallel rows at a same interval; and panels disposed between adjacent support ridges and provided with slightly swelled panel walls that are reversibly deformable into a dented shape, as seen in cross-sectional plan views.

Two functions are basically fulfilled by a synthetic resin bottle according to the above-described embodiment of the present disclosure. The depressurization-absorbing function is carried out by deforming reversibly the slightly swelled panel walls into a dented shape. The expansion-absorbing function is carried out by deforming the plane cross-sectional shape of the body from an out-of-round circle into a round shape. The support ridges ensure to maintain the rigidity of the bottle and to function as the boundaries between adjacent panels. Since the support ridges are disposed in sigmoid curves in parallel, each panel can be smoothly deformed into a dented shape under reduced pressure.

Under reduced pressure condition, the slightly swelled wall of each panel is reversibly deformed into a dented shape to reduce the volume inside the bottle greatly, and thus the depressurization-absorbing function can be fulfilled. If the support ridges serving as the boundaries for the panels were disposed straight in the vertical direction, the slightly swelled panel walls would be prevented from deforming smoothly into a dented shape, and portions of the slightly swelled walls would be distorted. This is because, once the swelled wall of a panel starts deforming into the dented shape, there occurs the force squeezing together with the swelled walls of the next panels by way of the support ridges.

The support ridges serving as the boundaries between panels are disposed in the sigmoid curves in parallel. Such sigmoid support ridges can be utilized in such a way that the dented area of each panel forms an oblique zone under reduced pressure, with the oblique zone extending from the left upper part of each sigmoid panel to the right lower part of the same panel. On the other hand, the panel deformation into the dented shape is restricted outside of this oblique zone, i.e., in the left lower part and the right upper part of each panel.

Because the depressurization causes the dented area to be formed in the oblique zone of each panel as described above, it is possible for the dented areas to be kept away from one another and to avoid the force squeezing together between adjacent panels through the intermediary of the support ridges. Under such a configuration, each panel can be smoothly reversed and deformed into the dented shape under reduced pressure.

If the sigmoid curve of the support ridges had too large an extent, the oblique zone would not be able to have a wide area when the above-described panel deformation into the dented shape takes place, and the bottle would have low rigidity. On the contrary, if the sigmoid curve had too small an extent, the force squeezing together would work through the support ridges. Therefore, the sigmoid curve shape should be determined in details as a matter of design, while giving consideration to the extent of deformation into the dented shape, the rigidity of the bottle, and outer appearance.

Meanwhile, the body has the plane cross-sectional shape of an out-of-round circle over almost the entire height of the body. When this cross-sectional shape of the out-of-round circle is deformed into a perfect circle, the expansion-absorbing function is fulfilled under pressure by such deformation of the plane cross-sectional shape. This is because the cross-sectional area can be enlarged by relatively small force without drawing the body wall in the circumferential direction.

For the convenience of explanation, a ratio of Sc/Sa (hereinafter referred to as Rs value) is defined as an index to show the out-of-roundness of a circle, where Sa represents the area of a plane cross section at a given height of the body; and Sc represents the area of the perfect circle having the same peripheral length as this plane cross section. If this Rs has a large value, the cross-sectional area increases at a higher rate when the body deforms into the perfect circle. Thus, it is possible to increase the expansion-absorbing function.

There are various shapes of out-of-round circles. The less number of corners there is in regular polygons, for example, or the flatter the elliptical shape is, the larger this Rs value grows. The Rs value of regular square shape, for example, is 1.27. With this value and the body shape after the deformation into the swelled shape taken into consideration, the plane cross-sectional shape of an out-of-round circle can be determined for the body.

According to an embodiment of the present disclosure, the crests are disposed at four points on the circumference at an interval corresponding to a substantially equal central angle over substantially the entire height of the body.

The number of the crests, and hence the number of the support ridges extending from the crests, are not specified in particular. However, well-balanced bottles can be obtained by disposing the crests at 4 points on the circumference at an interval corresponding to a roughly equal central angle and by disposing 4 support ridges in parallel. This balance should be acquired in terms of bottle capacity, the effective panel area that is associated with the depressurization-absorbing function, and the shape of the out-of-round circle in the plane cross sections of the body, which is associated with the expansion-absorbing function.

Further, each panel may be provided with a slightly hollowed panel wall that is reversibly deformable into a swelled shape and a slightly swelled panel wall that is reversibly deformable into a dented shape, the hollowed panel wall and the swelled panel wall being disposed next to each other, as can be seen in the cross-sectional plan views.

Each slightly hollowed panel wall has no large depressurization-absorbing function. However, the force that pulls the wall inward acts on this hollowed panel wall from the initial stage of depressurization, and at the same time, this force acts also on the swelled panel wall located adjacent to the hollowed panel wall, through the boundary between the hollowed wall and the swelled wall. This boundary can be used as a starting point for the swelled panel wall to be reversed and deformed into the dented shape. The hollowed panel walls are appropriately disposed, taking into consideration a preferred pattern of the deformation into the dented shape that occurs in the oblique zone. This pattern is determined by the shape of support ridges in the sigmoid curve. In this manner, the panel deformation into the dented shape can be smoothly promoted over the entire area of this oblique zone.

A large expansion-absorbing function can be fulfilled by deforming reversibly the slightly hollowed panel walls into the swelled shape under pressure. The area of the slightly hollowed panel walls may be widened, depending on the intended purpose, such as, e.g., the applications for which a large expansion-absorbing function is required. As the matters of designing there can be mentioned the proportion of areas, and the shape of the boundary, between the swelled panel wall and the hollowed panel wall that are adjacent to each other. These factors can be appropriately determined, taking into consideration the level of the required depressurization- or expansion-absorbing function and the preferred pattern of deformation.

According to an embodiment of the present disclosure, wherein said body has a plane cross-sectional shape of a perfect circle at both of the upper and lower ends of the body and has a reduced diameter at or near mid-height, the diameter being gradually reduced from a diameter at the upper and lower ends.

The portion of the body having a reduced diameter at or near the mid-height serves as the starting point of the panel deformation into the dented shape under reduced pressure. Thus, the panel deformation into the dented shape can be allowed to spread smoothly over the entire oblique zone.

It is also possible to increase the out-of-roundness (Rs value) from the level at both upper and lower ends of the body to the level at or near the mid-height. The expansion-absorbing function is fully achieved because the expansion caused by swelling is fully absorbed by the deformation of the body at or near the mid-height where the diameter has been reduced. The body can be deformed into the swelled shape without giving damage to outer appearance or to the self-standing ability of the bottle.

The cylindrical body of the bottle according to claim 4 has partly a contour line that is curved inward, with the concave bottom at the mid-height, as can be seen in the side view of the bottle. In order for the bottle as a whole to be prevented from a decrease in rigidity, it is preferred not to reduce the diameter at central-angle positions near the crests or to minimize the reduction in the diameter.

According to embodiments of the present disclosure, circumferential ribs may be disposed at both the upper and lower ends of the body.

The circumferential ribs disposed at both the upper and lower ends of the body set the upper and lower limits to the area in which the body is deformable with the change in pressure. These ribs also prevent the shoulder or the bottom from being deformed, and ensure that the outer appearance or bottle functions, such as self-standing ability, can be maintained.

According to an embodiment of the present disclosure, the synthetic resin bottle may be a biaxially drawn, blow-molded product made of a PET-related resin.

The biaxially drawn, blow-molded bottles made of a PET-related resin can be widely utilized as the bottles for drinks, have high mechanical properties at high and low temperatures, and can be used in a wide variety of applications.

PET is mainly used as the PET-related resin. In addition to a major part of ethylene terephthalate units, those copolymerized polyesters containing other polyester units can also be used unless the essential quality of the PET-related resin is spoiled. For example, a PET-related resin can be blended with a nylon-related resin or a polyethylene naphthalate resin to improve the gas barrier property or the heat-resisting property. The ingredients for use in copolymerized polyesters include dicarboxylic acids, such as isophthalic acid, naphthalene-2,6-dicarboxylic acid, and acidic acid; and glycol ingredients, such as propylene glycol, 1,4-butanediol, tetramethylene glycol, neopentyl glycol, cyclohexane dimethanol, and diethylene glycol.

Furthermore, PET-related resin bottle may be provided with an intermediate layer of a nylon resin, as given by the layers consisting of a PET resin—a nylon resin—a PET resin, for the improvement of the heat-resisting property and/or gas barrier property.

This invention having the above-described configuration has the following effects:

According to an above-described embodiment of the present disclosure, the depressurization-absorbing function is fulfilled by deforming reversibly the slightly swelled panel walls into a dented shape. The expansion-absorbing function is fulfilled by giving the body the plane cross-sectional shape of an out-of-round circle. The support ridges ensure to maintain the rigidity of the bottle and to function as the boundaries between adjacent panels. Since the support ridges are disposed in sigmoid curves in parallel, each panel can be smoothly deformed into the dented shape under reduced pressure.

According to an above-described embodiment of the present disclosure, well-balanced bottles can be obtained by disposing four support ridges in parallel. This balance should be acquired in terms of bottle capacity, the effective panel area that is associated with the depressurization-absorbing function, and the shape of the out-of-round circle in plane cross sections of the body, which is associated with the expansion-absorbing function.

According to an above-described embodiment of the present disclosure, the slightly hollowed panel walls can be used as the starting point for the reversible deformation of the slightly swelled panel walls into the dented shape. The swelled panel walls can be smoothly deformed reversibly into the dented shape, and this deformation can be spread over the entire area of these swelled panel walls. In addition, a large expansion-absorbing function can be fulfilled by deforming reversibly the slightly hollowed panel walls into the swelled shape under pressure.

According to an above-described embodiment of the present disclosure, the panel deformation into the dented shape can be made to proceed smoothly, with the reduced-diameter portion at about the mid-height of the body being used as the starting point. The expansion-absorbing function can be extensively fulfilled in the reduced-diameter portion at about this mid-height. The panel deformation into the swelled shape can be carried out without giving damage to outer appearance or the bottle functions, including self-standing ability.

According to an above-described embodiment of the present disclosure, the circumferential ribs disposed at both the upper and lower ends of the body set the upper and lower limits to the area in which the change in pressure causes the body to deform. These ribs keep the shoulder and the bottom from any deformation, and ensure that outer appearance and such performance as self-standing ability are maintained.

According to an above-described embodiment of the present disclosure, the biaxially drawn, blow-molded bottle made of a PET-related resin can be utilized in a wide variety of applications.

DETAILED DESCRIPTION OF EMBODIMENTS

Figure 1:
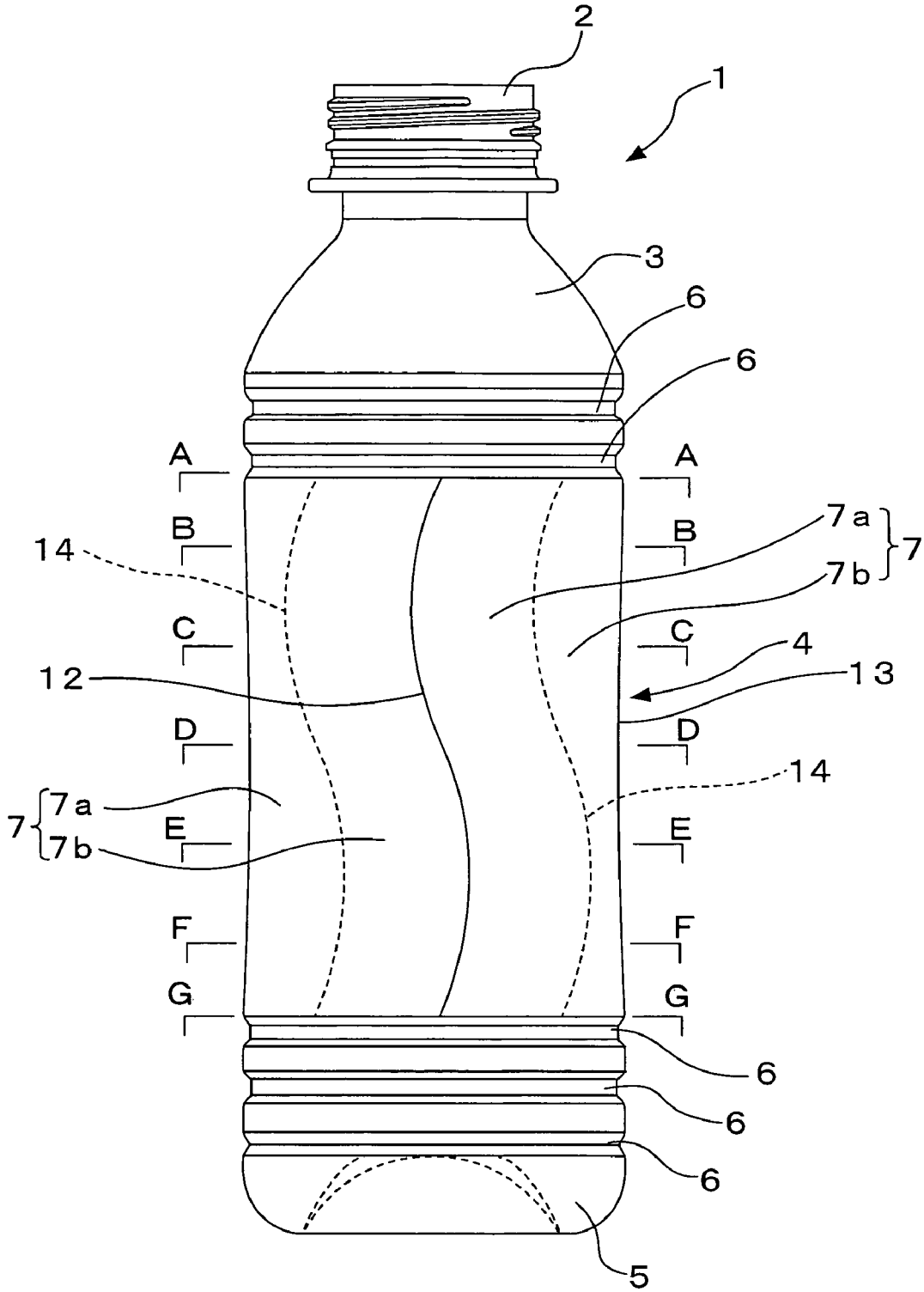
FIG. 1 is a front elevational view of the bottle in the first embodiment of present disclosure.
Figure 2:
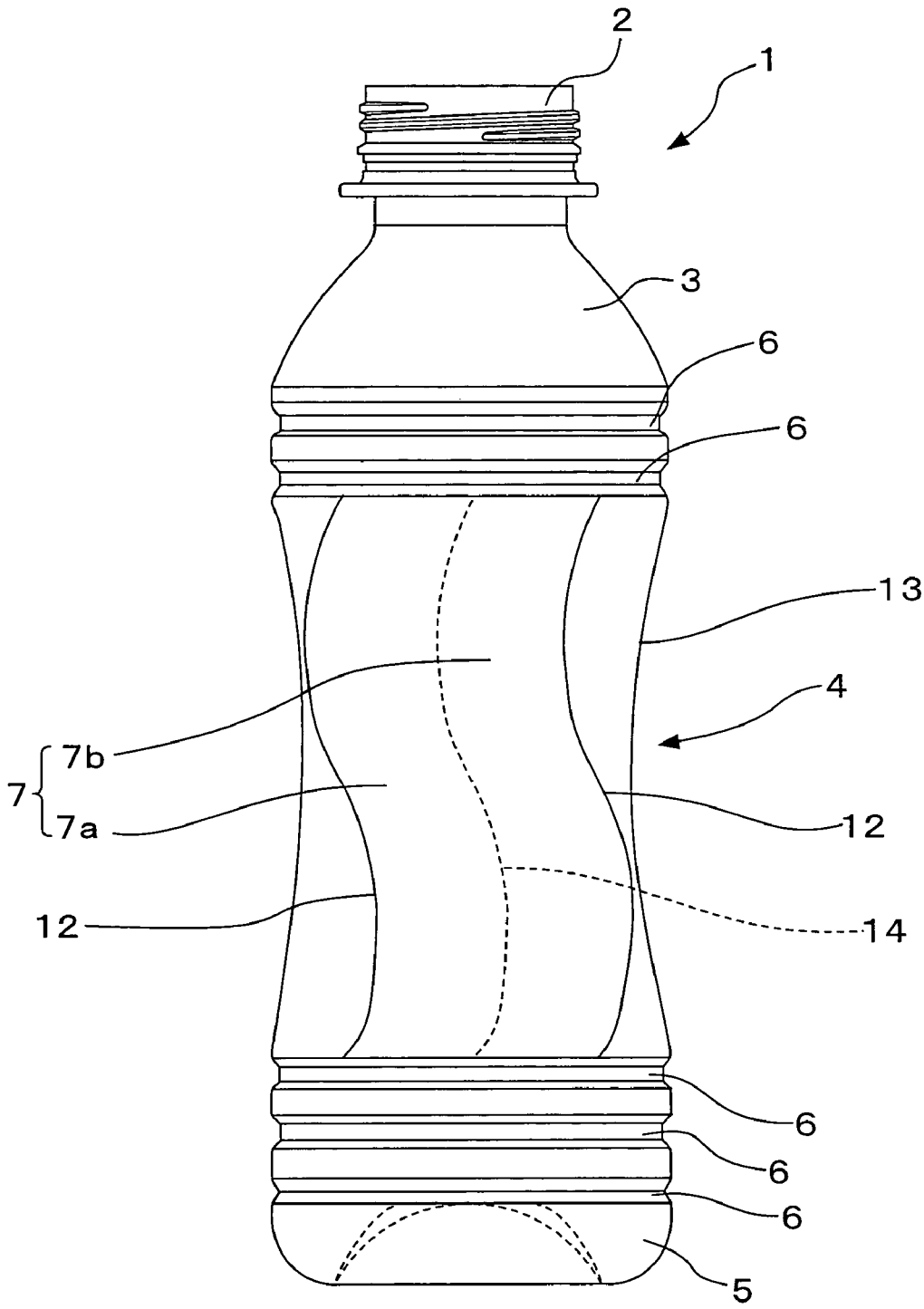
FIG. 2 is a side elevational view of the bottle of FIG. 1, taken from a position corresponding to a central angle of 45 degrees.

The present disclosure is further described with respect to a preferred embodiment. FIGS. 1-11 show the synthetic resin bottle in one embodiment of this invention, which is a biaxially drawn, blow-molded PET resin bottle with a capacity of 500 ml. FIG. 1 is a front elevational view, and FIG. 2 is a side elevational view, taken from a position corresponding to a later-described central angle of −45 degrees (See FIG. 3). On the whole, the bottle 1 is a cylindrical bottle consisting of four panels 7 disposed on the body 4. The bottle 1 comprises shoulder 3, the body 4, and bottom 5 that has a dome in the center.

Three circumferential ribs 6 and two such ribs are disposed, respectively, at the upper end and the lower end of the body 4. These ribs set the upper and lower limits to the deformation of the bottle 1 to be caused by the pressure change inside the bottle 1. Four support ridges 12 in gentle sigmoid curves are disposed in parallel in the area of the body 4 ranging from the place right under the upper circumferential ribs 6 to the place right on the lower circumferential ribs 6. Each support ridge 12 serves as a boundary between adjacent panels 7.

Between the right and left sides of each panel 7, there is a boundary 14, which is disposed in parallel to the support ridge 12 in the sigmoid curve. To the left of this boundary 14 is a slightly hollowed panel wall 7*a*, which is reversibly deformable into a swelled shape. To the right of this boundary 14 is a slightly swelled panel wall 7*b*, which is reversibly deformable into a dented shape. Thus, the hollowed panel wall 7*a* lies side-by-side with the swelled panel wall 7*b*.

When the body is observed in the longitudinal direction, the body wall contour 13 is gently curved inward in the body portion outside of the support ridges 12 (See FIG. 2). The curve ranges from the upper and lower ends of the body 4 to the mid-height portion.

FIGS. 3-8 are cross-sectional plan views of the bottle 1, taken at various heights ranging from line A-A to line G-G, respectively. The plane cross-sectional shape of the body 4 is a perfect circle at both the upper and lower ends (See FIG. 3). Crests 11*a*, 11*b*, 11*c* and 11*d* are disposed at four points on the circumference at an interval corresponding to an equal central angle (for example, an interval of 90 degrees in this embodiment) and are maintained at those points over the roughly entire height of the body 4, except for the portions where circumferential ribs 6 are formed (See FIGS. 4-8). The round circle drawn by a doffed line in FIGS. 4-8 corresponds to the plane cross-sectional shape of the body 4 shown in FIG. 3.

Figure 3:
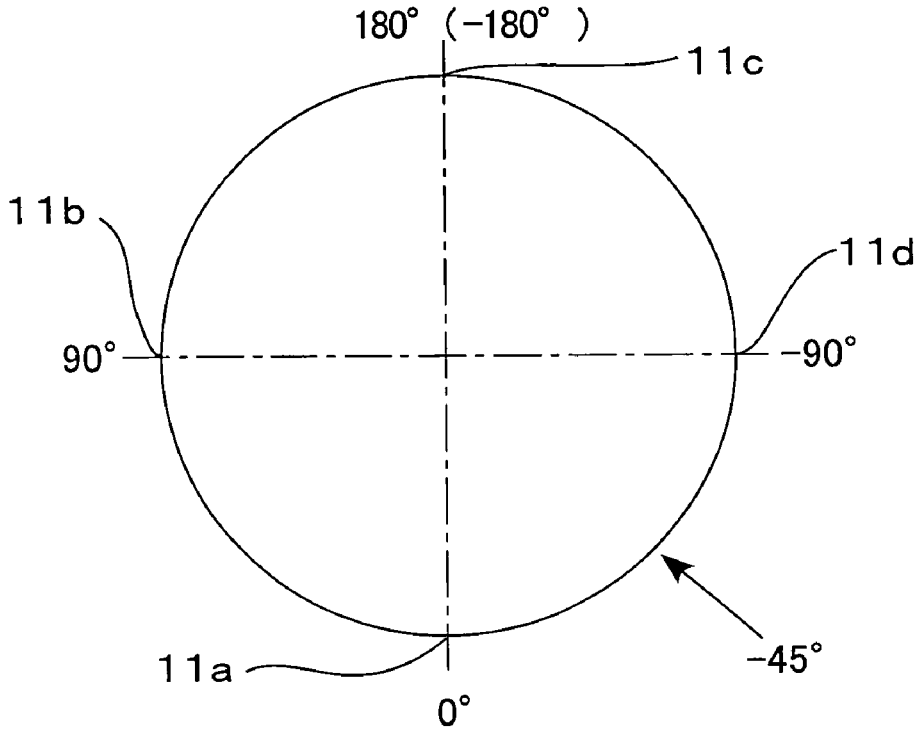
FIG. 3 is a cross-sectional plan view of the bottle of FIG. 1, taken from line A-A and line G-G.
Figure 4:
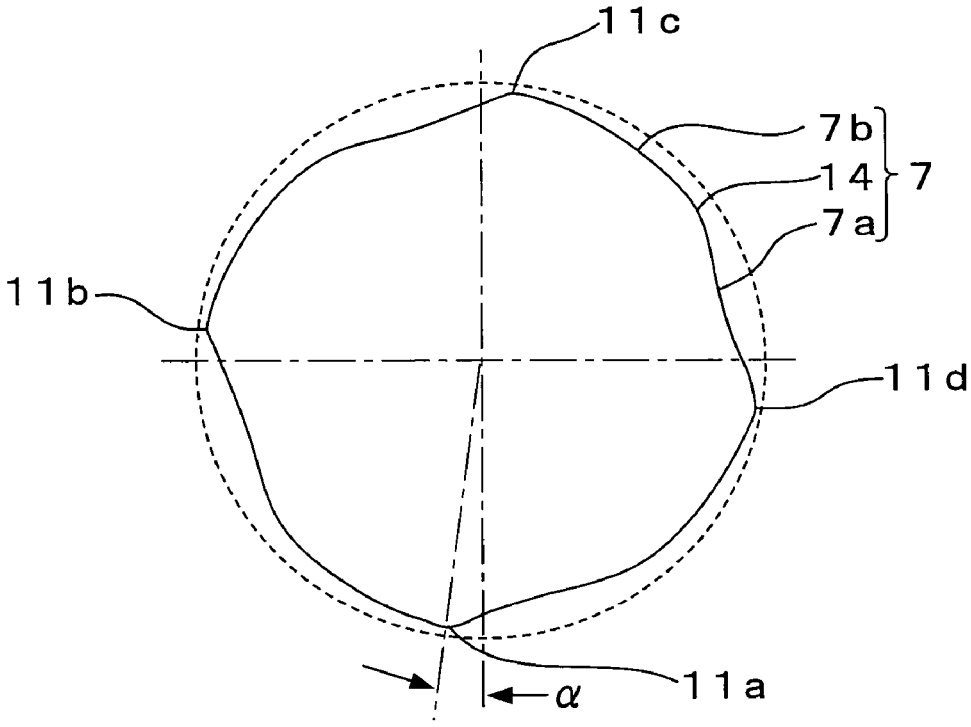
FIG. 4 is a cross-sectional plan view of the bottle of FIG. 1, taken from line B-B.
Figure 5:
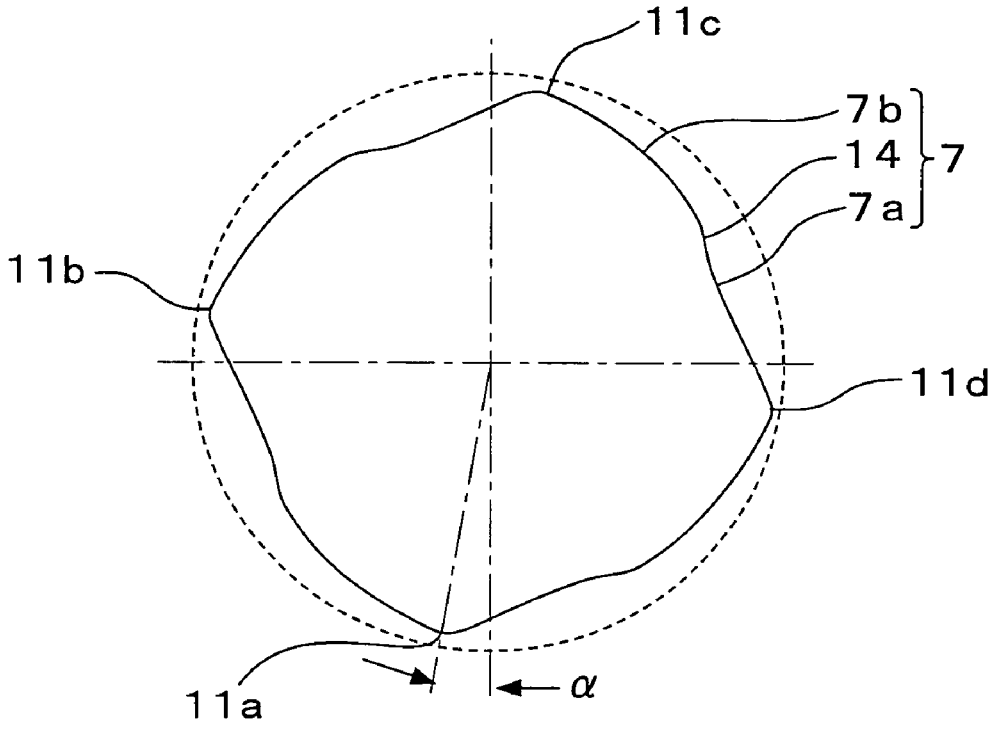
FIG. 5 is a cross-sectional plan view of the bottle of FIG. 1, taken from line C-C.

The angles in FIG. 3 are indicated to clarify the central angle, α, positions of the crests 11*a*, 11*b*, 11*c* and 11*d*, in the description below.

The crest 11*a*, taken as an example, has the gently swinging central angles, α, of 0 degree as a cross-sectional plan view is taken from line A-A right under the upper-end circumferential rib 6; 7.2 degrees, as taken from line B-B; 8.6 degrees, as taken from line C-C; and 0 degree again, as taken from line D-D at mid-height of the body. Then, the central angle swings to −8.6 degrees, as taken from line E-E; to −7.2 degrees, as taken from line F-F; and back to 0 degrees, as taken from line G-G right on the lower-end circumferential rib 6.

Other crests 11*b*, 11*c* and 11*d*, too, have similar swinging central angles. In this manner, each support ridge has the same central angle, α, at both upper and lower ends and mid-height of the body (0 degree for the support ridge i2 formed by the crest 11*a*). Under this condition, four support ridges 12 in a gentle sigmoid curve are formed along the body wall in parallel by the respective crests 11*a*, 11*b*, 11*c* and 11*d*.

Four panels 7 in all are formed on the body wall, and each panel 7 is surrounded by two adjacent support ridges 12 and by the circumferential ribs 6 at the upper and lower ends. The boundary 14 runs down longitudinally in the center and equally divides the panel into the slightly hollowed panel wall 7*a* on the left side, which is reversibly deformable into the swelled shape, and the slightly swelled panel wall 7*b* on the right side, which is reversibly deformable into the dented shape.

In the wall portion of the body 4 where the support ridges 12 are disposed, the body 4 has a reduced diameter at or near mid-height, with the diameter being gradually reduced from the diameter at both ends. In this embodiment, the reduction in diameter is quite small at positions of the central angles, α, of 0, ±90, and 180 degrees (as observed from the body wall contour 13 in FIG. 1). On the other hand, at or near ±45 and ±135 degrees, the body has much larger reduction in diameter (See the body wall contour in FIG. 2). Such a design is intended to minimize the decrease in the rigidity of the bottle 1.

The plane cross-sectional shape of the body 4 gradually changes from the shape of a perfect circle at both the upper and the lower end to the shape close to a rectangle at mid-height (See FIGS. 3-8). The Rs value, indicative of the extent of out-of-roundness for the plane cross section, is set high for the wall portions ranging from both the upper and lower ends to the mid-height position.

Figure 9:
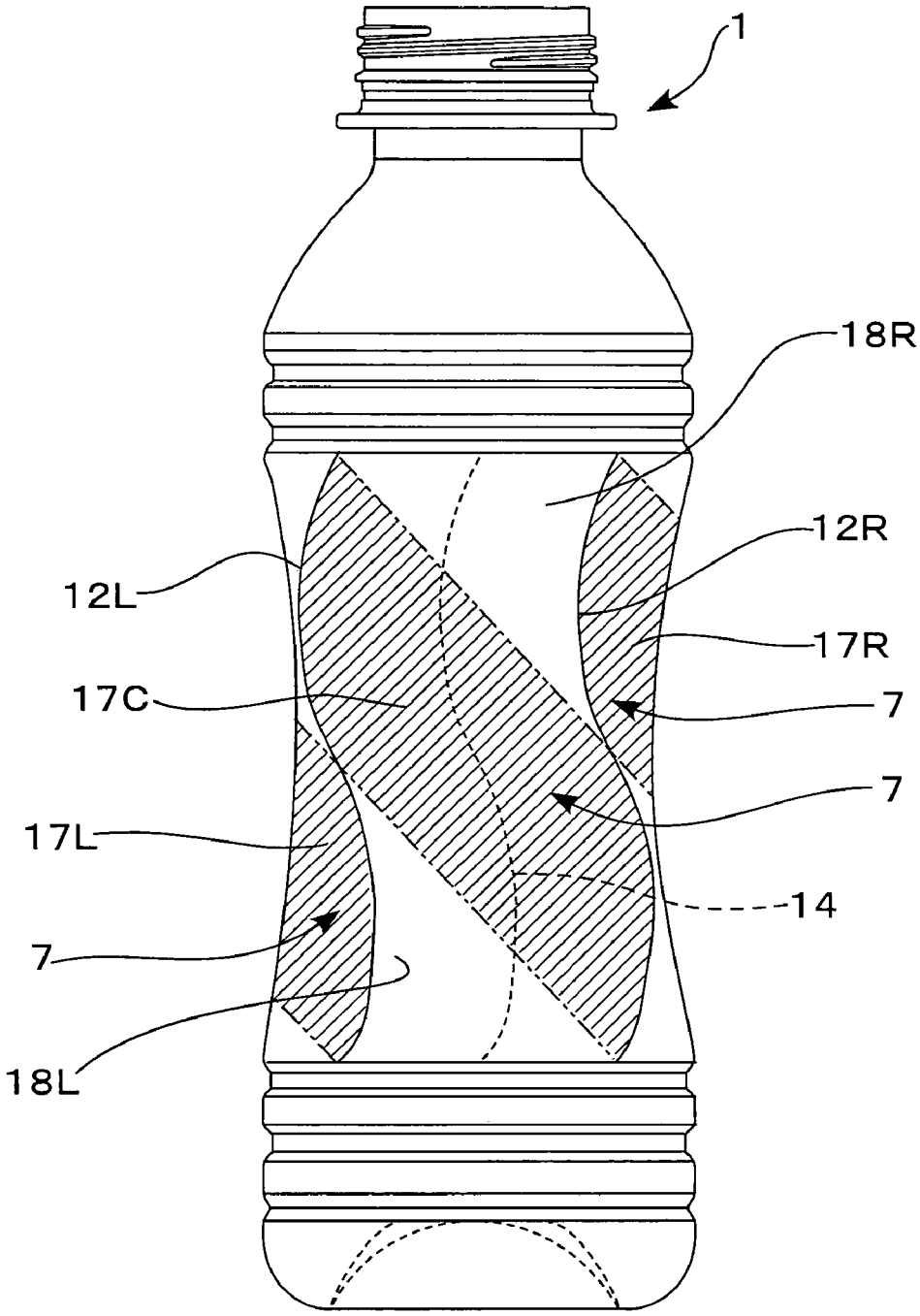
FIG. 9 is an explanatory diagram of the bottle of FIG. 2 showing a pattern of panel deformation observed under reduced pressure.

The bottle 1 of this embodiment is further described with respect to the pattern of panel deformation under reduced pressure and under pressure. FIG. 9 is an explanatory diagram using the side elevational view of FIG. 2 and showing a pattern of panel deformation under reduced pressure. The panel deformation into the dented shape mainly occurs in the oblique zone 17C as shown by the hatching, which ranges from the upper half area in contact with the left-hand support ridge 12L to the lower half area in contact with the right-hand support ridge 12R. The panel deformation into the dented shape seldom occurs in the portions of the panel other than this oblique zone 17C, i.e., in the areas including a left lower portion 18L and a right upper portion 18R.

Similar panel deformation into the dented shape occurs in all the panels 7, and generally gives the dented zones that are oblique as shown in FIG. 9. As obvious from this drawing, the oblique zone 17C can be configured so as not to come in contact with adjacent oblique zones 17L and 17R, to which the support ridges 12L and 12R set the borders. Under this configuration, it is possible to avoid the force squeezing together from acting between the two adjacent panels because of a support ridge 12 bordering these two panels. Therefore, the deformation of each panel 7 into the dented shape, including the reversible deformation of the slightly swelled panel walls 7*b*, can be achieved uniformly and smoothly.

Figure 6:
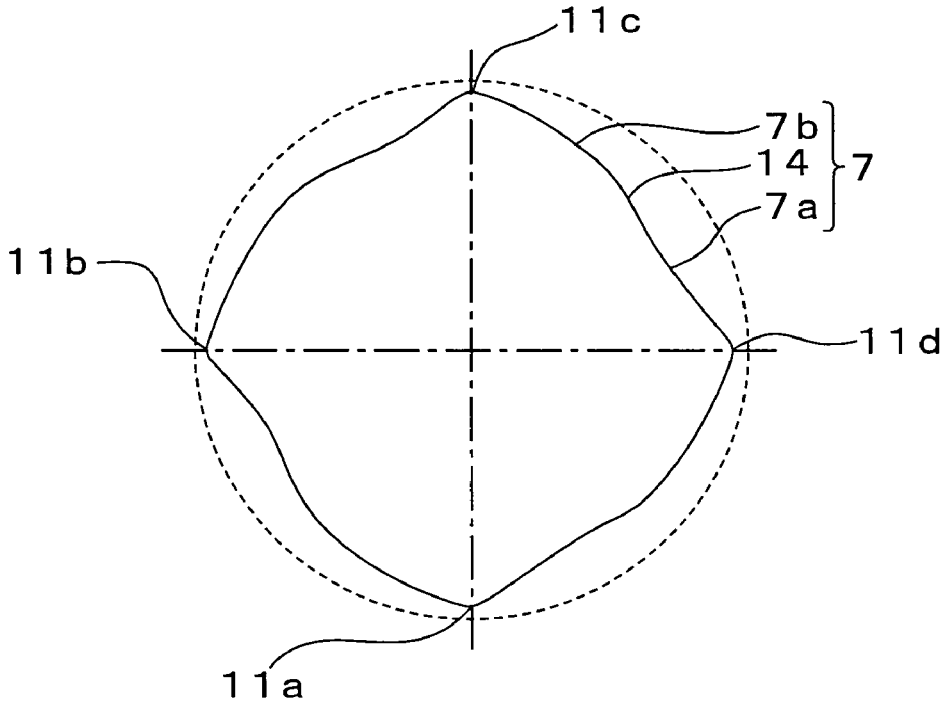
FIG. 6 is a cross-sectional plan view of the bottle of FIG. 1, taken from line D-D.
Figure 7:
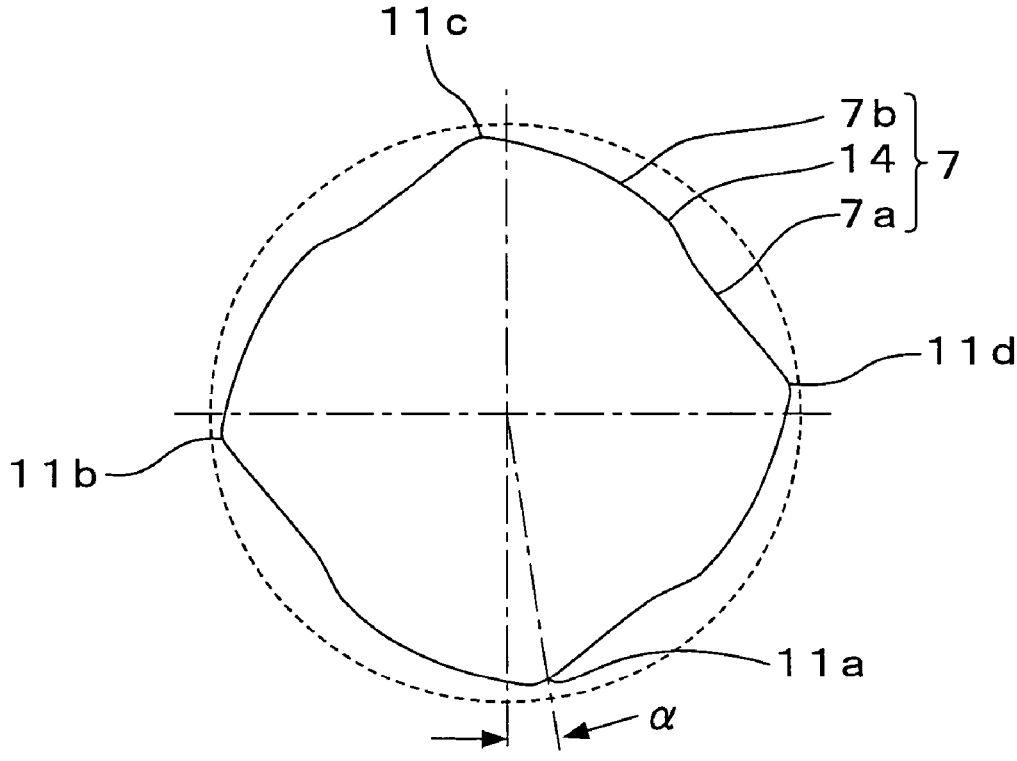
FIG. 7 is a cross-sectional plan view of the bottle of FIG. 1, taken from line E-E.
Figure 8:
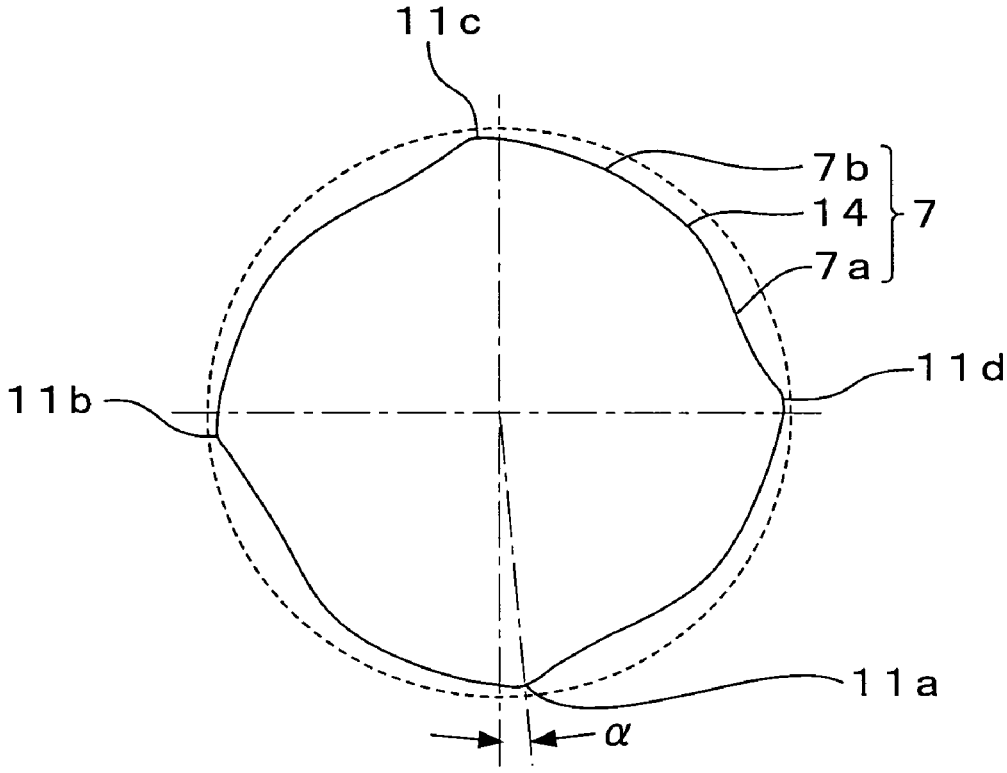
FIG. 8 is a cross-sectional plan view of the bottle of FIG. 1, taken from line F-F.
Figure 10:
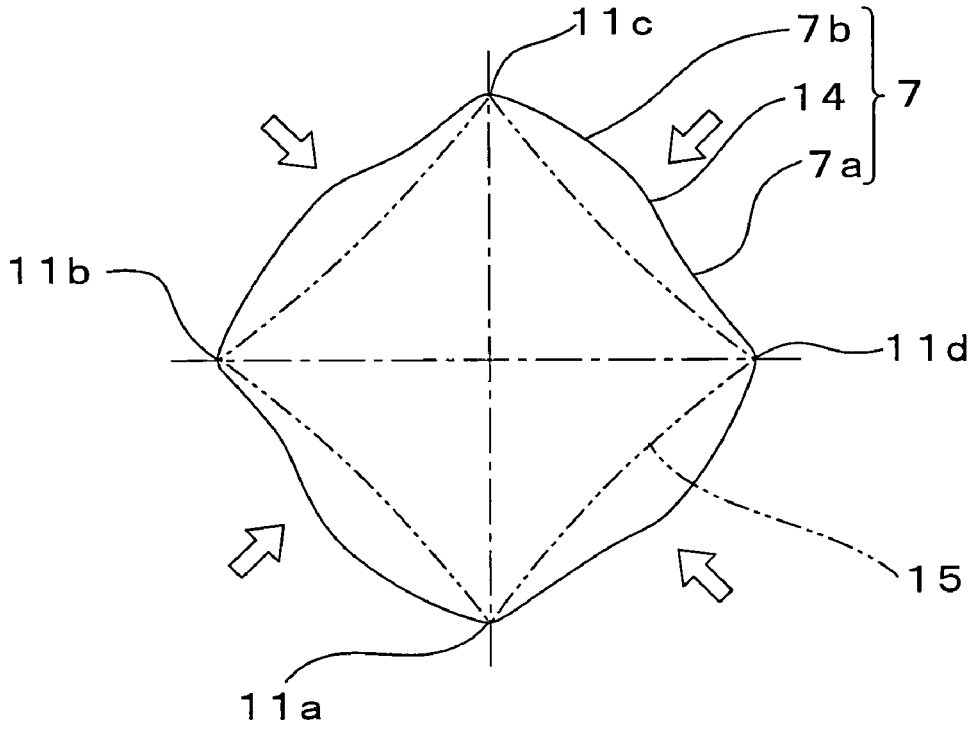
FIG. 10 is an explanatory diagram of the bottle of FIG. 6 showing a pattern of panel deformation observed under reduced pressure.

FIG. 10 is an explanatory diagram showing a pattern of deformation observed under reduced pressure in the plane cross section of FIG. 6, taken from line D-D at the mid-height position. If the bottle is filled with the contents at a high temperature in the range of 80-90 degrees C., then with the progress of cooling, the panel walls are deformed into the dented shape 15, as shown in chain double-dashed lines. Thus, the dented panels 7 achieve the depressurization-absorbing function.

If relatively large areas of slightly swelled panel walls 7*b* are formed, as is the case in this embodiment, it is preferred that slightly hollowed panel walls 7*a* are appropriately disposed so that the hollowed panels 7*a* lie side-by-side with the swelled panel walls 7*b*, as designed in this embodiment. This is because at the time of panel deformation into the dented shape, the entire area of each swelled panel wall 7*b* may not be deformed uniformly into the dented shape, but because only part of each swelled panel is dented locally.

When the depressurization starts, the force squeezing from outside acts on the panels 7 (in the directions of outline arrows in FIG. 10). At first, the hollowed wall 7*a* of each panel is deformed into the dented shape. Then, this deformation spreads to the adjacent swelled panel wall 7*b* beyond the boundary 14. With this boundary 14 serving as the starting point, the swelled panel wall 7*b* can be smoothly deformed into the dented shape.

Figure 11:
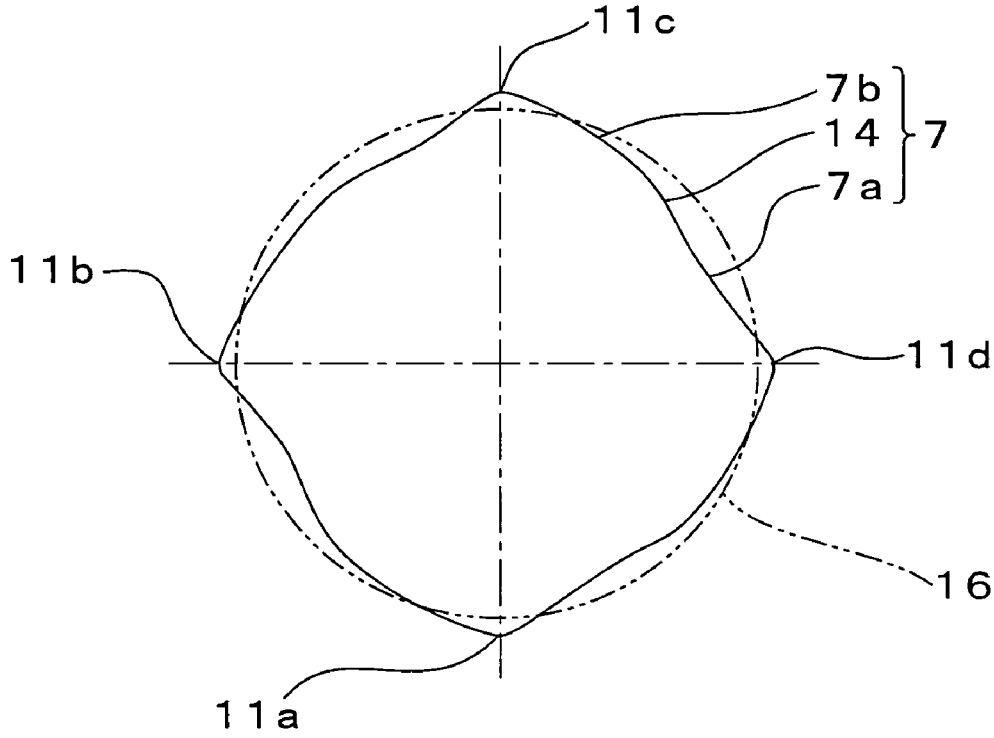
FIG. 11 is an explanatory diagram of the bottle of FIG. 6 showing a pattern of panel deformation observed under pressure.

FIG. 11 is an explanatory diagram showing the deformation of the panels 7 observed at the mid-height position in the plane cross section taken from line D-D, when the inside of the bottle 1 is changed from normal pressure to a pressurized state. For example, if the contents are frozen, or if the retort treatment by means of steam heating process is used, the cross section of the bottle is deformed into a swelled shape close to a perfect circle 16, as shown by the chain double-dashed line, and thus, the expansion-absorbing function is at work.

The panel deformation into the swelled shape caused by above-described pressurization increases in scale especially in the reduced-diameter portion of the body 4 at or near the mid-height, as compared to other portions of the entire body height. Since there is little deformation in the shoulder 3 and the bottom 5 due to the action and effect of the circumferential ribs 6 disposed at both the upper and lower ends, this panel deformation into the swelled shape can be maintained without giving much damage to outer appearance of the body 1 or to such features as self-standing ability and storage life As described above, the plane cross section of the body 4 has a shape close to a rectangle at or near mid-height (See FIG. 6). The body 4 in such a shape, coupled with the hollowed panel wall 7*a* that reversibly deforms into the swelled shape, serves to bring out a fully large expansion-absorbing function. When each hollowed panel wall 7*a* deforms reversibly into the swelled shape, the adjacent swelled panel wall 7*b* first deforms into a further expanded shape, in the order opposite to the time when the panels deform under reduced pressure. This panel deformation into the swelled shape spreads to the adjacent hollowed panel wall 7*a* beyond the boundary 14. With this boundary 14 serving as the starting point, the hollowed panel wall 7*a* begins the reversed deformation into the swelled shape. Finally, the panels 7 are in the swelled state 16 over the entire areas.

The action and effect of this invention is not limited to the above-described embodiment. The number of the crests 11 in a plane cross-sectional shape of the body 4, and hence the number of the support ridges 12, are not limited to four. Thus, the number may also be three or six, and can be determined, depending on the purpose of use and taking the factors of outer appearance into consideration.

In addition, the panels 7 can be formed solely by the swelled panel walls 7*b*. Even if the panels 7 comprise the slightly swelled panel walls 7*b* and the slightly hollowed panel walls 7*a* that are adjacent to each other, as in this embodiment, the area proportion between both panel walls, the shape of the boundary 14, and the like are still the matters of design, which can be determined appropriately, taking into consideration the depressurization- or expansion-absorbing function to be required, the patterns of deformation, etc.

Figure 12:
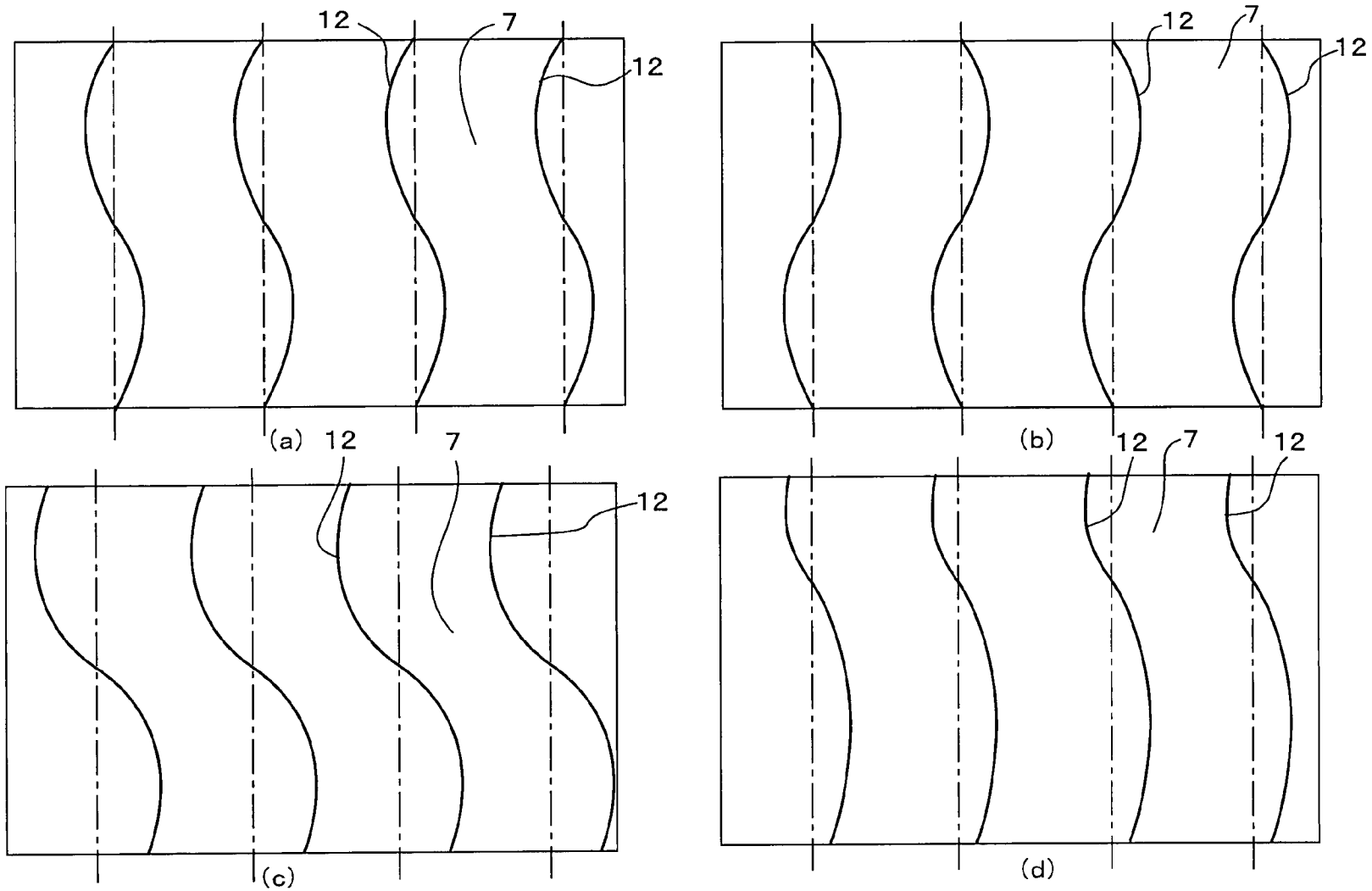
FIG. 12 is an explanatory diagram showing variations of the support ridge disposed in parallel, in which a part of the body is opened up and spread.
Figure 13:
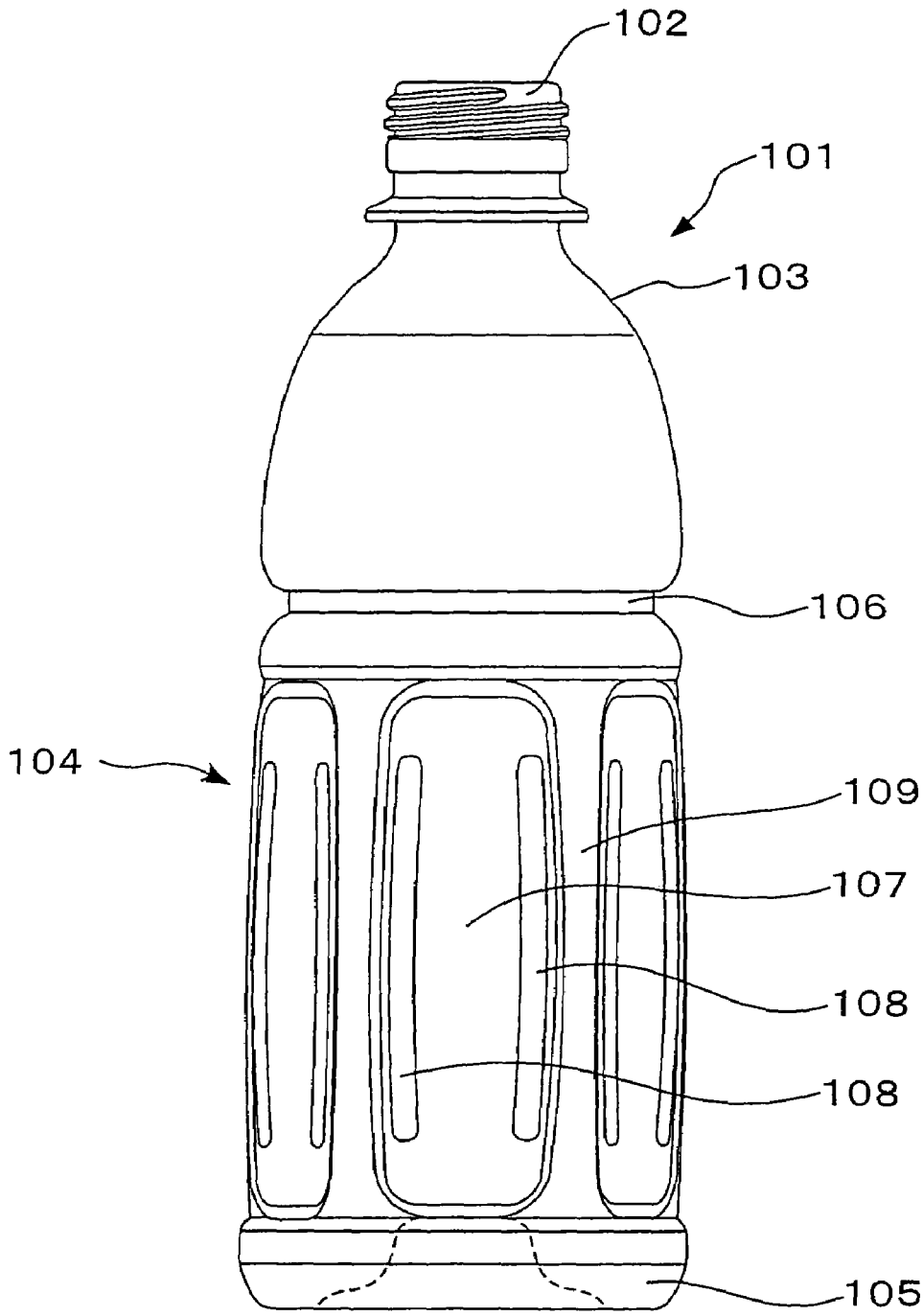
FIG. 13 is a front elevational view of a conventional bottle.

FIG. 12 shows some variations in the pattern of the sigmoid support ridges 12 disposed in parallel, where (a) is the pattern used in this embodiment; (b), a pattern of counter-sigmoid curve that is opposite of the pattern of (a); (c), a pattern with the support ridge starting from the left side at the upper end and reaching the right side at the lower end; and (d), a pattern similar to (c), above, but in which the upper sigmoid curve is shortened, while the lower counter-sigmoid curve is elongated. Thus, the sigmoid support ridges 12 can have various patterns, and can be appropriately determined, taking into consideration the pattern of the oblique zones 17 that are formed under reduced pressure, the deformation properties of the swelled panel walls 7*b* that are reversed into the dented shape, and outer appearance.

The shape of the bottle is also not limited to the shape used in this embodiment. The type of the synthetic resin to be used is not limited to the PET-related resins.

INDUSTRIAL APPLICABILITY

The synthetic resin bottle of this invention can be utilized in various applications in which the inside of the bottle is put under reduced pressure, under pressure, or under both conditions of depressurization and pressurization. It is expected that such a bottle will be utilized in a wide range of applications.

What is claimed is:

1. A synthetic resin bottle comprising:

a body having an upper end and a lower end and a plane cross-sectional shape of a circle, the circle being out-of-round over substantially an entire height of the body, the body including:

crests disposed at three or more points on a circumference of the circle at substantially a same interval, wherein a central angle ($\alpha$) position of each crest fluctuates similarly vertically along the height of the body;

support ridges formed by the crests in sigmoid curves and disposed at least in three substantially parallel rows at a same interval; and panels disposed between adjacent support ridges and provided with slightly swelled panel walls that are reversibly deformable into a dented shape, as seen in cross-sectional plan views.

2. The synthetic resin bottle according to claim 1, wherein the crests are disposed at four points on the circumference at an interval corresponding to a substantially equal central angle over substantially the entire height of the body.

3. The synthetic resin bottle according to claim 2, wherein circumferential ribs are disposed at both the upper and lower ends of said body.

4. The synthetic resin bottle according to claim 1, wherein each of said panels is further provided with a slightly hollowed panel wall that is reversibly deformable into a swelled shape, the slightly hollowed panel wall and the slightly swelled panel wall being correspondingly disposed next to each other, as seen in the cross-sectional plan views.

5. The synthetic resin bottle according to claim 4, wherein circumferential ribs are disposed at both the upper and lower ends of said body.

6. The synthetic resin bottle according to claim 1, wherein said body has a plane cross-sectional shape of a perfect circle at both of the upper and lower ends of the body and has a reduced diameter at or near mid-height, the diameter being gradually reduced from a diameter at the upper and lower ends.

7. The synthetic resin bottle according to claim 6, wherein circumferential ribs are disposed at both the upper and lower ends of said body.

8. The synthetic resin bottle according to claim 1, wherein circumferential ribs are disposed at both the upper and lower ends of said body.

9. The synthetic resin bottle according to claim 8, wherein the synthetic resin bottle is a biaxially drawn, blow-molded product made of a polyethylene terephthalate-related resin.

* * * * *

UNITED STATES PATENT AND TRADEMARK OFFICE

CERTIFICATE OF CORRECTION

PATENT NO. : 7,467,725 B2
APPLICATION NO. : 11/119760
DATED : December 23, 2008
INVENTOR(S) : Toshimasa Tanaka and Takao Iizura It is certified that error appears in the above-identified patent and that said Letters Patent is hereby corrected as shown below:

Column 7, line 58: “doffed” should be “dotted.”

Signed and Sealed this

Third Day of March, 2009

JOHN DOLL
*Acting Director of the United States Patent and Trademark Office*